US005658209A

United States Patent [19]

Blakemore

[11] Patent Number: 5,658,209

[45] Date of Patent: Aug. 19, 1997

[54] GOLF CLUB HEAD WITH OPTIMUM DISTRIBUTED MASS CONTOUR

[75] Inventor: Ralph W. Blakemore, Westminster, Colo.

[73] Assignee: John T. Godwin, Pine Mountain, Ga.

[21] Appl. No.: 555,452

[22] Filed: Nov. 9, 1995

Related U.S. Application Data

[63] Continuation of Ser. No. 265,917, Jun. 27, 1994.

[51] Int. Cl.[6] ..... A63B 53/04

[52] U.S. Cl. ..... 473/350; 473/291

[58] Field of Search ..... 473/324, 332, 473/349, 350, 287, 290, 291

[56] References Cited

U.S. PATENT DOCUMENTS

| | | | |
|---|---|---|---|
| 4,026,561 | 5/1977 | Baldorossi et al. | 273/199 R |
| 4,802,672 | 2/1989 | Long | 273/169 |
| 4,854,581 | 8/1989 | Long | 273/169 |
| 5,048,834 | 9/1991 | Gorman | 273/169 |
| 5,056,788 | 10/1991 | Katayama | 273/167 F |
| 5,356,138 | 10/1994 | Chen et al. | 273/169 |

*Primary Examiner*—William M. Pierce
*Attorney, Agent, or Firm*—Kenneth E. Darnell

[57] ABSTRACT

Golf club heads each having a specifically contoured back side shaped to provide an optimal three-dimensional mass distribution, the invention preferably takes the form of "oversize" iron club heads having an unusually large "sweet spot" while retaining traditional iron head weights. The optimally distributed mass of each head is provided over the entire back side of the head with the back side contour interacting with face-stiffening ribs located on the top and toe of the head to yield performance advantages. The versatility found in the contouring of the back side of each head to yield optimal mass distribution allows the hitting area of each club face in a set of clubs to increase incrementally as the loft of each iron decreases, thereby resulting in a more uniform "sight picture" between clubs as viewed by the player.

23 Claims, 6 Drawing Sheets

GOLF CLUB HEAD WITH OPTIMUM DISTRIBUTED MASS CONTOUR

This application is a continuation of application Ser. No. 08/265,917, filed Jun. 27, 1994, abandoned.

BACKGROUND OF THE INVENTION

1. Field of the Invention

The invention relates generally to golf club heads and particularly to optimally proportioned golf club heads especially suited as irons.

2. Description of the Prior Art

The popularity of the game of golf likely resides in the virtual impossibility of mastering the game due to its technical complexity as well as the emotional factor brought about in part by the extraordinary difficulty of consistently striking the ball with accuracy and confidence. Over generations substantial improvements have come about in the tools used to play the game of golf, particularly the various clubs which include a group of clubs known as irons. A full set of golfing irons can include eleven separate irons which are usually numbered 1 through 9 with a "long" iron having a lower number. Such a set also includes a pitching wedge and a sand wedge. Irons include a head joined to a hosel and a shaft with the shaft being attached to the head by fitting the shaft into a bore formed in the hosel. The hosel is typically attached to and formed integrally with the head of an iron. It is conventional in the art for the head to include a heel, a bottom sole, a toe, a planar striking face and a back side.

The irons within a set of irons conventionally are formed to have varying degrees of loft angle and lie angle. The loft angle of an iron is that angle between a vertical plane, which includes the shaft, and the plane of the striking face of the iron. The lie angle of an iron is the angle between the shaft and the ground (horizontal plane) when the tangent to the sole directly under the center of mass is in the horizontal plane and when the shaft lies in a vertical plane. The loft angle of an iron determines how much loft is imparted to the ball when it is struck by the tilted striking face of the iron. The lie angle of the iron assures that when swung properly, the sole of the iron will contact the ground evenly so that the striking face will not tend to twist inwardly or outwardly and thereby ruin a shot made with the iron.

In a conventional set of irons, each iron has a number of horizontal grooves extending across the planar striking face. These horizontal grooves assist in imparting back spin to a golf ball when the ball is struck by the planar striking face. When the planar striking face fails to impart backspin to the ball, the ball may flutter and not fly an anticipated distance and will not hold or bite the playing surface of a course upon landing. For any set of golf irons, it is important that for a consistent swing, the iron impart consistant loft and distance to the ball. It is also important that when properly swung, the iron produces a consistent shot without a tendency to hook or slice.

Conventional golfing iron designs can be said to be either a traditional design wherein the iron is forged and has a generally continuous back portion on the club blade or of a second type wherein the design of the iron is referred to as a "cavity back" design wherein the back portion of the club blade includes a substantial depression or cavity which has the effect of providing perimeter weighting for the club head. Clubs of the "cavity back" style which include perimeter weighting have shown to provide a larger "sweet spot" or hitting area such that a ball need not be struck precisely in the center of mass of the club to produce an acceptable golf shot.

Golf clubs having oversize heads have also come to be known in the art and have been produced to the end of providing a greater sweet spot. Such "oversize" clubs do not preserve traditional head weights such as a player is comfortable with and typically do not provide a visual presentation to a player which promotes the confidence of the player. Player confidence is substantially improved when the player can consistently impact a golf ball on the "sweet spot" of a club. When a ball is not hit on the sweet spot of a golf club head, the club head will tend to twist from a position of being square with the intended flight path of the ball. The energy thus transferred to the golf ball is therefore less than maximum with a resultant loss in distance as well as a deviation from an ideal flight path.

The cavity back or perimeter weighted clubs referred to above as prior art club heads have intended to address the problem of off-center impact with a golf ball, that is, impact away from the sweet spot of the club head, so that the club head is forgiving, that is, the ball need not be struck precisely in the center of mass of the club to obtain an acceptable result. In a cavity back or perimeter weighted club, the club head is formed with a central hollow or cavity in the back surface of the club and material which would otherwise be located in the cavity is redistributed in predetermined proportions to strategic locations on the club head. A relatively large mass in such clubs is concentrated in the sole of the club in order to lower the center of gravity. A golfer therefore can more easily place the center of gravity of the club head below the center of gravity of the golf ball at the moment of impact for producing a properly airborn and solidly hit ball. Further, relatively large concentrations of mass are located in the heel and toe areas of a cavity back club in order to minimize the effects of hitting a golf ball on the toe or heel of the club head. When toe or heel hits occur, a club head will twist about the point of impact and result in less than a maximum transfer of energy to the golf ball at impact and deviations from the intended flight path of the ball. Such club heads are thus provided with relatively large concentrations of mass in the toe and heel areas of the club head so that the moment of inertia is increased and the golf club head will resist twisting movements in response to laterally off-centered hits.

Cavity back club structures have been provided by Solheim in U.S. Pat. No. 5,193,805, the club heads of Solheim having enlarged mass concentrations formed as protuberances at the heel and toe ends of a top ridge of the club head which extends longitudinally along the upper part of the head between the heel and toe ends of the head. U.S. Pat. No. 5,011,151 to Antonious discloses a club head having a mass referred to as a toe counterweight located above a theoretical longitudinal axis of the club head. The longitudinal axis is defined by Antonious as bisecting the face of the club head and is shown in the patent as extending between the heel and toe of the club head. The toe counterweight is a relatively large mass concentration which blends smoothly with the mass of the sole so that the counterweight appears to be an upwardly sweeping extension of the sole. In U.S. Pat. No. 5,209,473, Fisher describes golf irons wherein each blade includes a substantially planar face portion which is generally oval in shape and a back portion which is generally oval in shape and is disposed opposite the planar face portion. The back portion of the clubs of Fisher includes a cavity which is generally oval in shape with a torsion ring being provided which completely surrounds the the cavity and distributes the weight thereof around the perimeter of the cavity. Long, in U.S. Pat. Nos. 4,802,672 and 4,854,581 provides golfing irons which have progressively decreasing displacements between the axis of the shaft and the center of mass projected to a horizontal plane beginning with the long irons and progressing to the short irons. Each iron in a set provided by Long also has a support column behind the striking face, parabolic shaped horizontal grooves in the striking face, and a flat segment on the sole centered below the center of mass to cause the head to sit squarely at address. A still further example of a weighted iron club head is provided by Scheie et al in U.S. Pat. No. 5,224,705 wherein a golf club head is provided with a cavity having a pair of side walls which extend at certain angles to the hosel of the club head. The shape of cavity positions in the Scheie et al club heads positions a substantial portion of the weight of the heads in the upper portion of the toe of the head and in the lower portion of the heel of the head.

While substantial activity has occurred in the art with the intent of producing improved golfing club heads and particularly iron heads, the art has not provided an oversize iron head having a visual presentation which promotes player confidence and which provides an optimally distributed mass over the entire back side of the iron head, thereby producing an unusually large sweet spot such that player confidence is singularly promoted. Therefore, the present club heads address a long-felt need in the art by providing a new and improved club head and a new and improved set of club heads which address the needs of both the skilled golfer and the relatively unskilled golfer in their continuing attempts to master the game of golf.

SUMMARY OF THE INVENTION

The present invention particularly provides golf club heads and a set of golf clubs which are irons, the iron heads of the invention having enlarged dimensions relative to conventional iron heads such as those irons manufactured under the trademark of Ping. The present enlarged iron heads provide an increased sweet spot while retaining traditional iron head weights due primarily to the provision of an optimally distributed mass over the entire back side of the iron head along with face-stiffening ribs located on the top and toe of each head. The three-dimensional mass distribution which is optimally provided over the entire back side of each iron head is uniquely determined for each of the various iron head sizes.

The invention further provides an increased and more uniform "sight picture" due to an incremental increase in the hitting area of each iron face in a set of the present clubs, the hitting area increasing incrementally as the loft of each iron decreases. The unique visual performance characteristics of the present club heads essentially provides a consistent face projected area so that a user looking down at the club head sees a relatively large, confidence inspiring head size.

It is therefore an object of the invention to provide a club head and a set of club heads, particularly iron heads, wherein mass is optimally distributed over the entire back side of each head in three dimensions such that head enlargement is obtained along with the creation of an unusually large sweet spot to improve the playing of the game of golf.

It is another object of the present invention to provide a club head and a set of club heads, particularly iron heads, having optimally distributed mass over the back side of an iron head and combined with face stiffening ribs located on the top and toe of each head, thereby resulting in an unusually large, structurally rigid club face which retains traditional iron head weights.

It is a further object of the invention to provide a club head and a set of club heads, particularly iron heads, wherein the hitting area of each iron face in a set increases incrementally as the loft of each iron decreases, thereby providing a more uniform sight picture to a player and providing each iron head with a visual performance characteristic which promotes player confidence.

Further objects and advantages of the invention will become more readily apparent in light of the following detailed description of the preferred embodiments.

DESCRIPTION OF THE PREFERRED EMBODIMENTS

Figure 1:
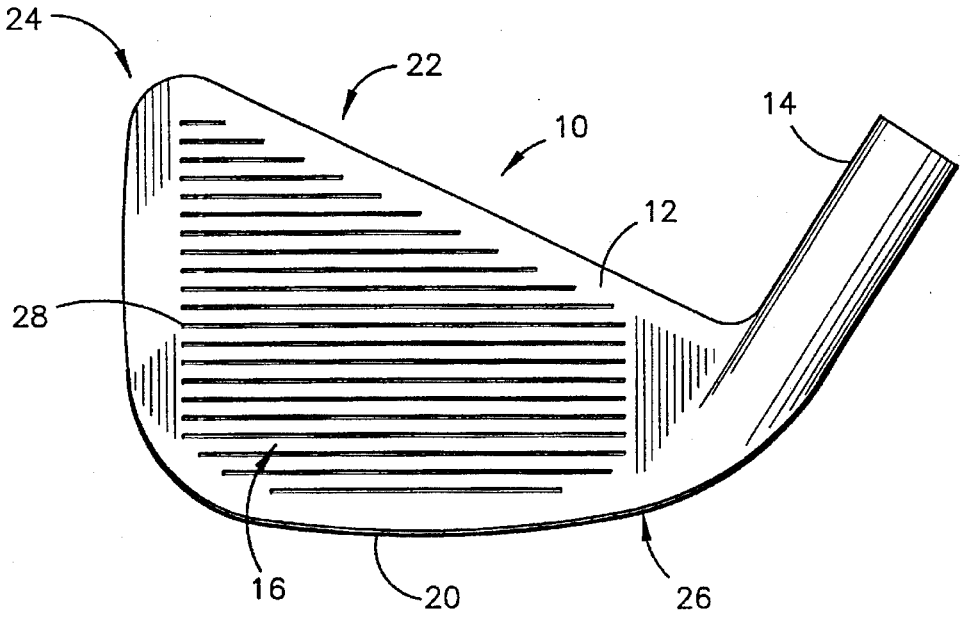
FIG. 1 is a front perspective view of a golf club head configured according to the present invention.
Figure 2:
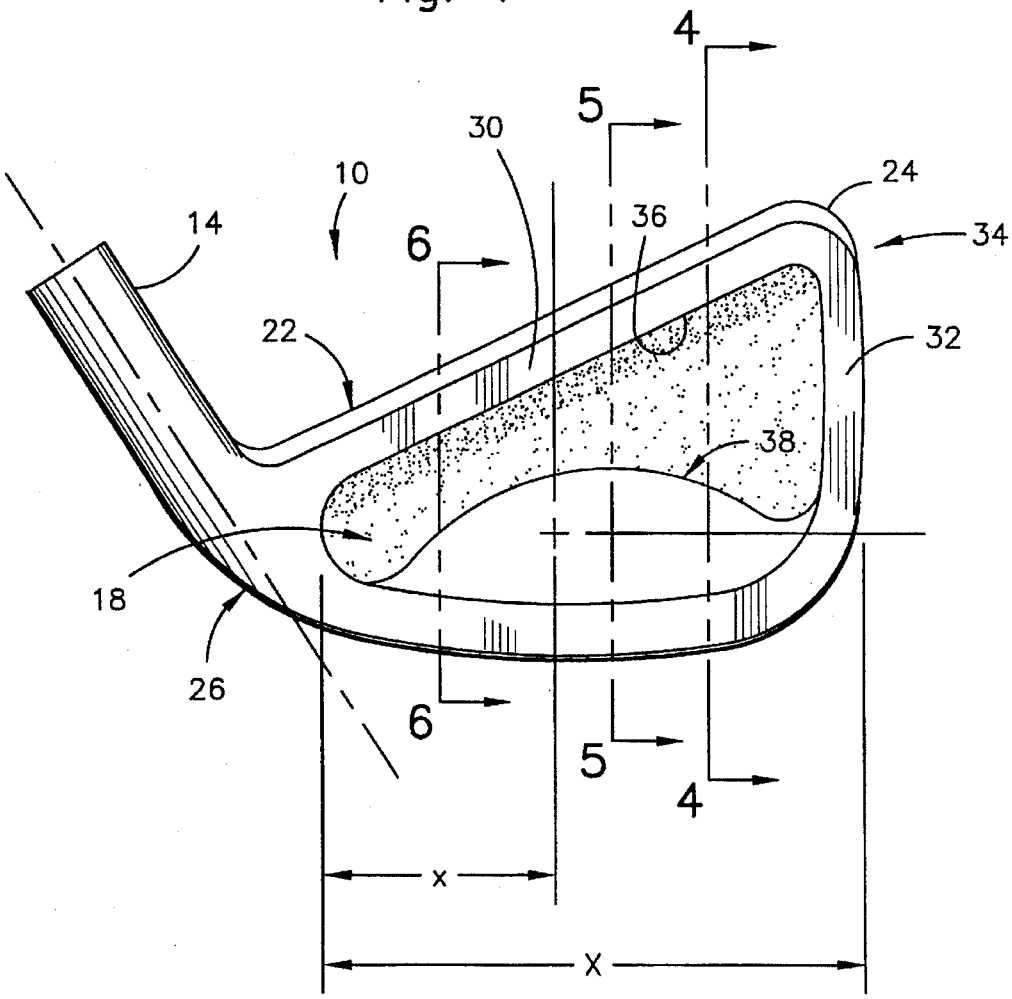
FIG. 2 is a rear perspective view of the club head of FIG. 1.
Figure 3:
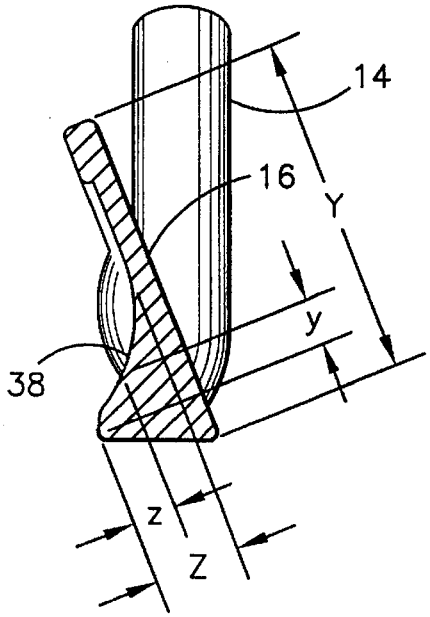
FIG. 3 is a toe end view of the club head of FIG. 1.

Referring now to the drawings and particularly to FIGS. 1 through 3, an iron club head 10 representative of the structure of the iron club heads comprising the present set of clubs is seen to include a blade 12 and a hosel 14 which is typically formed integrally with the blade 12 for attachment of a shaft (not shown). The blade 12 includes a flat front face 16, a back side 18, a sole 20 and a top edge 22. The sole 20 and the top edge 22 extend between the face 16 and the back side 18. The blade 12 further includes a toe 24 and a heel 26, the heel 26 connecting the blade 12 with the hosel 14. As is particularly seen in FIG. 1, a plurality of elongated and substantially parallel grooves 28 are formed on the flat front face 16 or striking face of the club head 10. The provision of the grooves 28 on the face 16 is conventional in the art.

Referring now to FIGS. 2 and 3, the back side 18 of the head 10 is best seen to include a face-stiffening rib 30 formed substantially along the top edge 22 of the head 10. A face-stiffening rib 32 is formed on the toe 24 of the head 10. The ribs 30 and 32 join at 34 and define along their respective lengths a portion of a relief 36 into which relief extends a mass contour 38 of dimensions for each club of a set of clubs which will be described in detail hereinafter. The mass contour 38 is seen best in FIG. 2 to have an arcuate shape extending from a line substantially above the sole 20 of the head 10 with the greatest intrusion of the mass contour 38 into the relief 36 being substantially centrally of the back side 18 of the head 10. From this central portion of the back side 18, the mass contour 38 slopes on one side toward the heel 26 of the head 10 and on the other side toward the portion of the sole 20 below the toe 24. As will be seen, the mass provided within the compound contour surfaces of the mass contour 38 allows an oversize club head 10 with significantly enhanced performance. The location of the mass provided by the mass contour 38 interacts with the ribs 30 and 32 to create an unusually large sweet spot while preserving iron head weights which are similar to traditional weights.

While the iron club head 10 of FIGS. 1 through 3 could be chosen to be any particular iron within the present set of irons, the head 10 is taken for no reason more than convenient choice to be sized and shaped as a #4 iron.

The iron club head 10 is of a size greater than conventional "mid-sized" and "over-sized" iron heads due to the optimally distributed mass provided by the mass contour 38 over the back side 18 of said head 10. Since iron heads are fairly limited as to the material which can be employed, carbon steel and various stainless steels being standard, the materials per se of prior traditional iron heads have limited the total volume of such iron heads. This limitation imposed by material led head design from the nearly constant thickness of "tour blade" iron heads to "perimeter weighted" iron heads which have allowed some increase in club face size. In perimeter weighted heads, in contradistinction to the perimeter stiffened iron club heads of the invention, material is removed in the accepted ball striking region of a club face and placed around the perimeter of the club head. Such perimeter weighted heads allow a certain degree of enlargement of the club face. It is imperative to understand the difference between the present perimeter stiffened iron club heads and the perimeter weighted heads which are conventional. In the perimeter stiffened structures of the present invention, optimum mass is distributed over the entire back side 18 of the head 10 by means of an analytical process which defines the mass contour 38. The club heads 10 of the present invention have uniquely contoured back sides in three dimension for each iron head of a set, this mass contour 38 interacting with the ribs 30 and 32 to provide an unusually large, structurally rigid face which essentially preserves traditional iron head weights. The mass contour 38 seen on the head 10 can be scaled for smaller heads than the oversize head structures of the invention. In contradistinction, perimeter weighted club heads cannot be scaled to the sizes of the present club heads with retention of acceptable performance.

The optimally distributed mass of the present club heads as represented by the mass contour 38 of head 10 provides design versatility necessary for producing an increased sight picture size of the iron heads of the present invention which can be seen to promote player confidence due to the increased size which the present heads present to a golf player when compared with previous conventional structures. In the present invention, the length of each iron face in a set of clubs increases incrementally. For example, a wedge has the shortest face length with the #1 iron having the longest face. The incremental sizes coupled with proportional increases in face height combined with the face angle (loft) provides a more consistent face projected area. A more uniformly sized sight picture is thus provided by each iron head when viewed from the address position. In essence, the hitting area of each iron face in a set of clubs configured according to the invention increases incrementally and proportionally as the loft of each iron decreases. A more complete description of this characteristic of the present club heads will be provided hereinafter.

Referring again to FIG. 2, the shape of the optimized mass provided by the mass contour 38 provides the major mass distribution of the club head 10 in and around the center of mass, that is, the balance point, of the club head 10. In the several club heads of the invention, approximately 60% of the mass of the head is in symmetry. This optimally distributed mass allows the weight of the club head 10 to be essentially the same weight as a conventional "tour blade" iron head.

Figure 15:
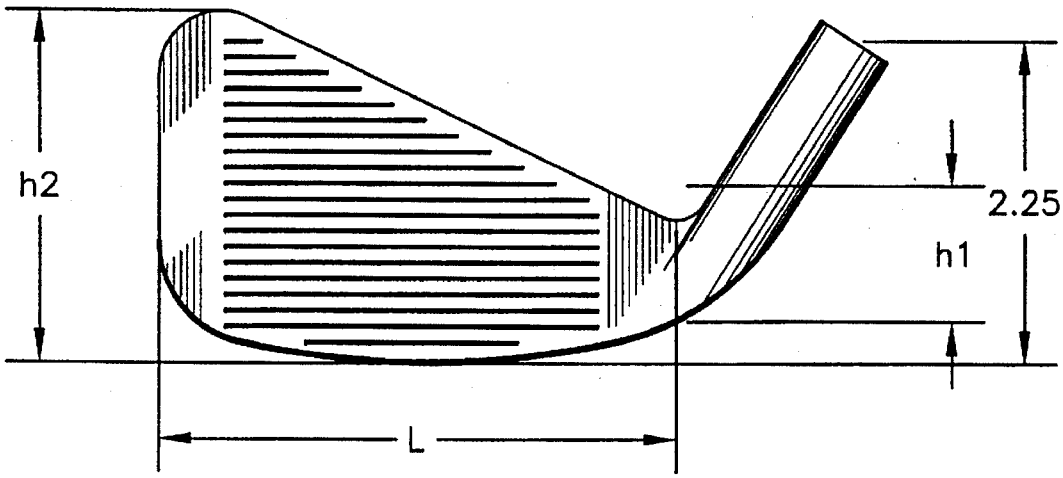

As an example, a #5 iron according to the invention is approximately 1.3 times larger than a standard Ping Eye 2 #5 iron. The sizing of the present club heads decreases as the loft of the club head increase. In general, the optimally shaped mass on the back side 18 of the present club heads 10 provided by the mass contour 38 has a surface contour which moves closer to the heel 26 on the more lofted club heads 10 of a set configured according to the invention and moves more closely to the toe 24 on less lofted clubs, thereby enhancing performance by maximizing the area of the sweet spot. In order to appreciate these features of the various club head sizes represented by the club head 10, reference is made to FIG. 15 wherein the length and heights h2 and h1 at the toe and heel respectively are provided in inches for irons #4, #6, #8 and pitching wedge with loft being given in degrees, area in square inches and area ratio being related to the area of the pitching wedge. Table I provides these values:

TABLE I

| Iron | Loft, deg. | h1, in | h2, in | L, in | Area, sq in | Area Ratio |
|---|---|---|---|---|---|---|
| 4 | 24 | 1.25 | 2.62 | 3.38 | 2.5 | 0.60 |
| 6 | 32 | 1.25 | 2.50 | 3.31 | 3.1 | 0.74 |
| 8 | 40 | 1.25 | 2.38 | 3.28 | 3.7 | 0.88 |
| PW | 48 | 1.25 | 2.38 | 3.25 | 4.2 | 1.0 |

Figure 14:
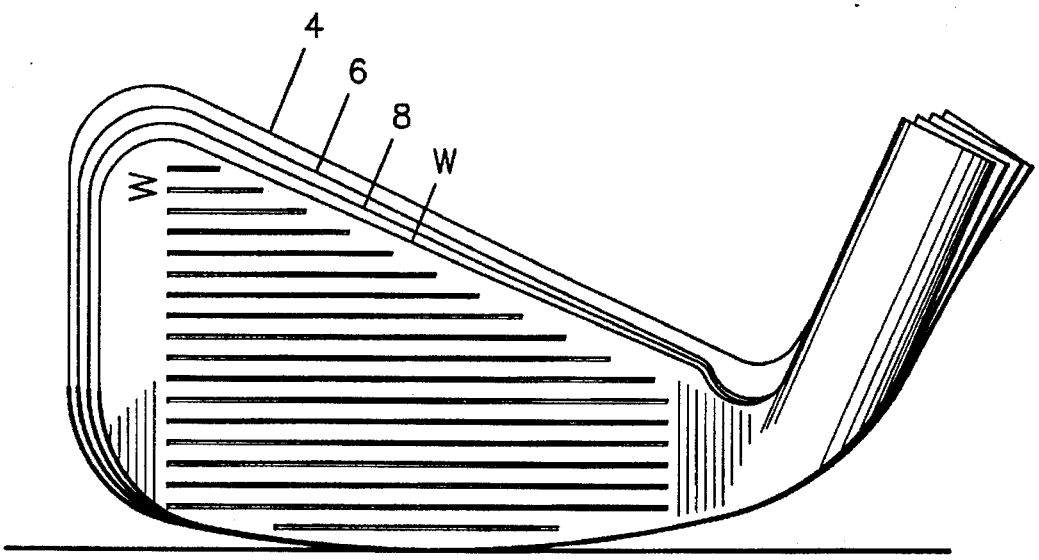
FIG. 14 is a schematic illustrating size distributions of the club heads of the invention seen in a front perspective; and, FIG. 15 is a schematic useful in illustrating the dimensions of a club head configured according to the invention.

FIG. 14 illustrates the four iron club heads particularly referred to in Table I with a full size representation of the four club heads of the table. As is also seen in FIG. 14, the soles 20 of each of the club heads are radiused in order to fit the lie angles of different players and to further prevent the club heads from digging.

Figure 4:
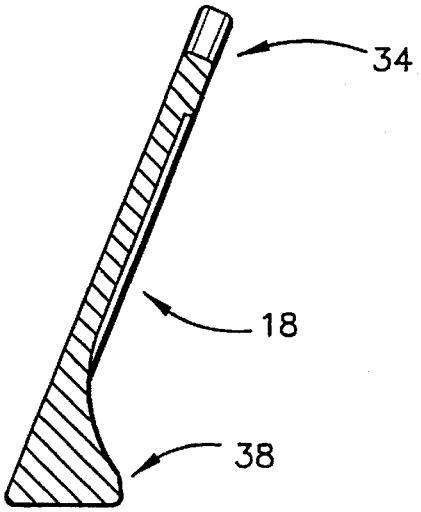
FIG. 4 is a section taken along lines A—A of FIG. 2.
Figure 5:
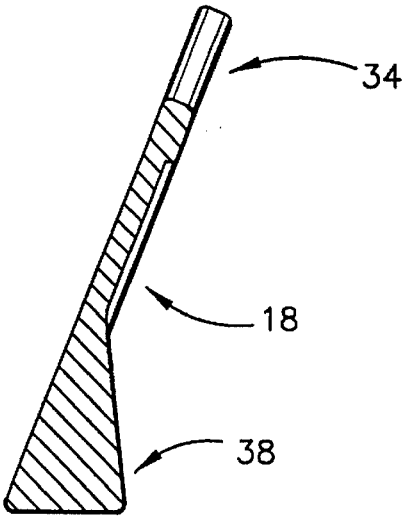
FIG. 5 is a section taken along lines B—B of FIG. 2.
Figure 6:
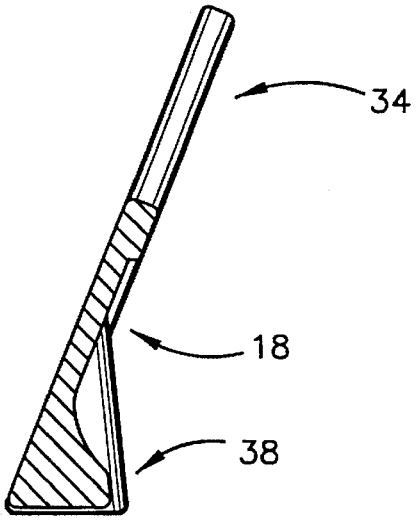
FIG. 6 is a section taken along line C—C of FIG. 2.
Figure 11:
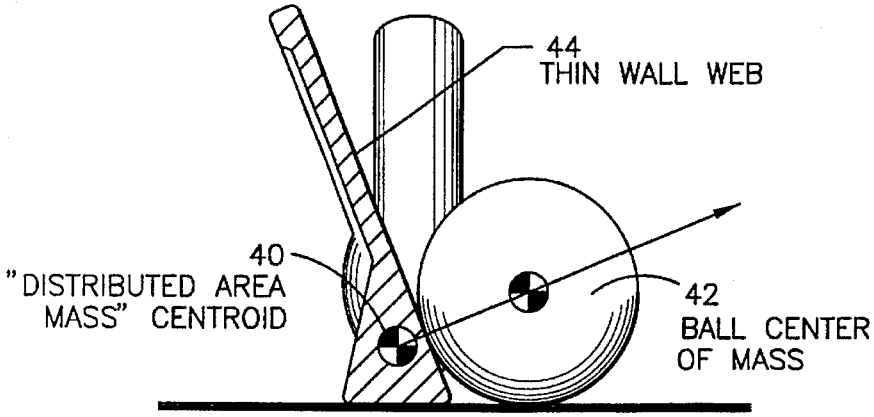
FIG. 11 is a schematic of a typical iron according to the invention drawn in contact with a golf ball.

Referring now to FIGS. 4 through 6, the thickness of the mass contour 38 can be seen respectively at locations near the hosel 14, the center of the head 10 and near the toe 24 of the club head 10. This optimally distributed mass provided by the mass contour 38 is conveniently shown for a #4 iron since FIGS. 4 through 6 relate to FIG. 2. It is to be appreciated from a review of FIGS. 4 through 6 that the mass contour 38 tapers toward the hosel and toward the toe end of the club head 10 such that less mass is provided at the respective ends of the club head 10 with the greatest proportion of the mass being located medially of the length of the sole 20 with that mass near the sole 20 tapering into the relief 36 centrally of the back side 18 of the head 10. The mass contour 38 further tapers into the relief 36 from those locations extending toward the heel 26 and the toe 34 of the club 10. As is seen in FIG. 11, the optimally distributed mass provided by the mass contour 38 provides a distributed mass area centroid at 40 which is located toward the sole 20 of the club head 10 and which provides an enlarged sweet spot since the center of mass of a ball 42 being struck by the club head 10 can effectively align with the centroid 40 over an enlarged portion of the flat front face 16 when compared to conventional iron club heads. As can be appreciated from FIG. 11 as well as from FIGS. 4 through 6 upper portions of the blade 12 above the mass contour 38 take the form of a web 44 having relatively thin rigid walls when compared with conventional cavity back iron club heads. Accordingly, the mass of the blade 12 is optimally distributed toward the sole 20 of the head rather than toward the top edge 22 of the head 10. The provision of the face-stiffening ribs 30 and 32 as aforesaid enables the web 44 to be relatively thin thus allowing total club head weight to be substantially no greater than the weights of traditional iron club heads.

Figure 7:
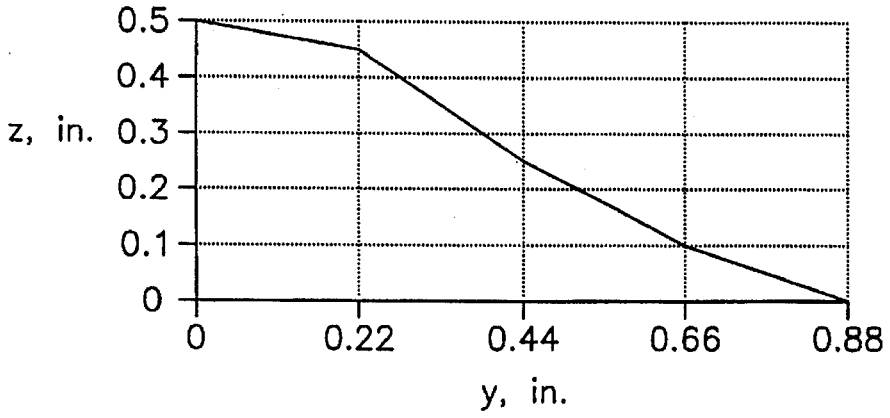
FIG. 7 is a graph roughly illustrating the determination of an optimized distributed mass over the back side of any iron in a set of irons according to the invention.
Figure 8:
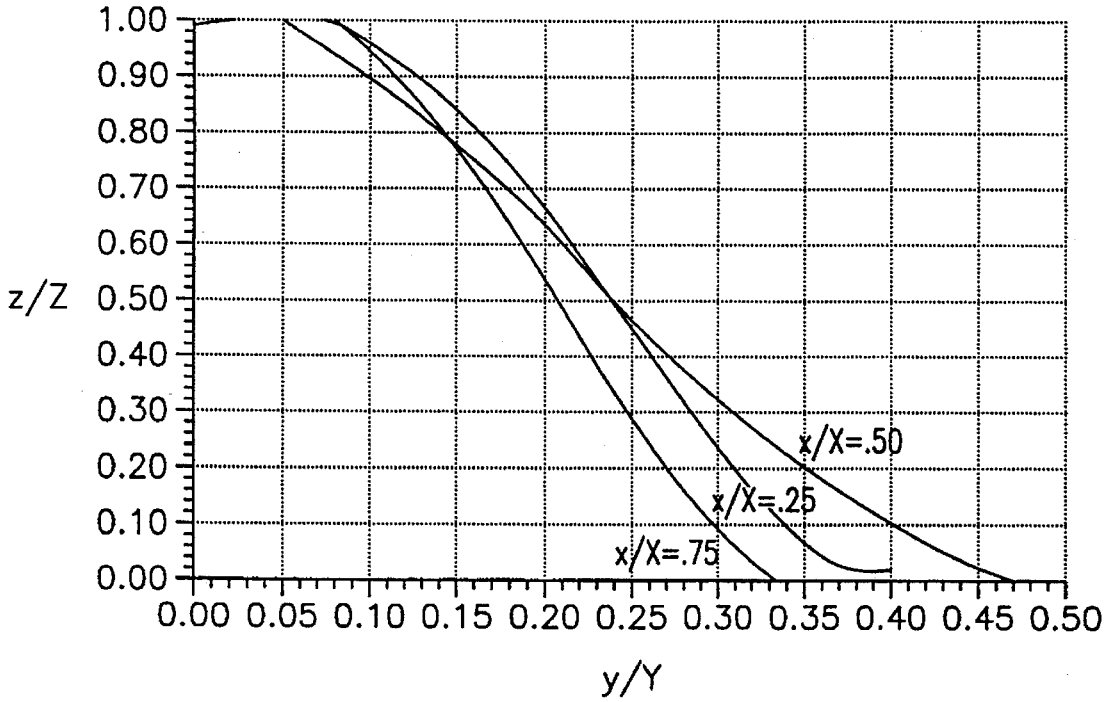
FIG. 8 is a graph illustrating the optimally distributed mass contour on the back side of a four iron according to the invention.
Figure 9:
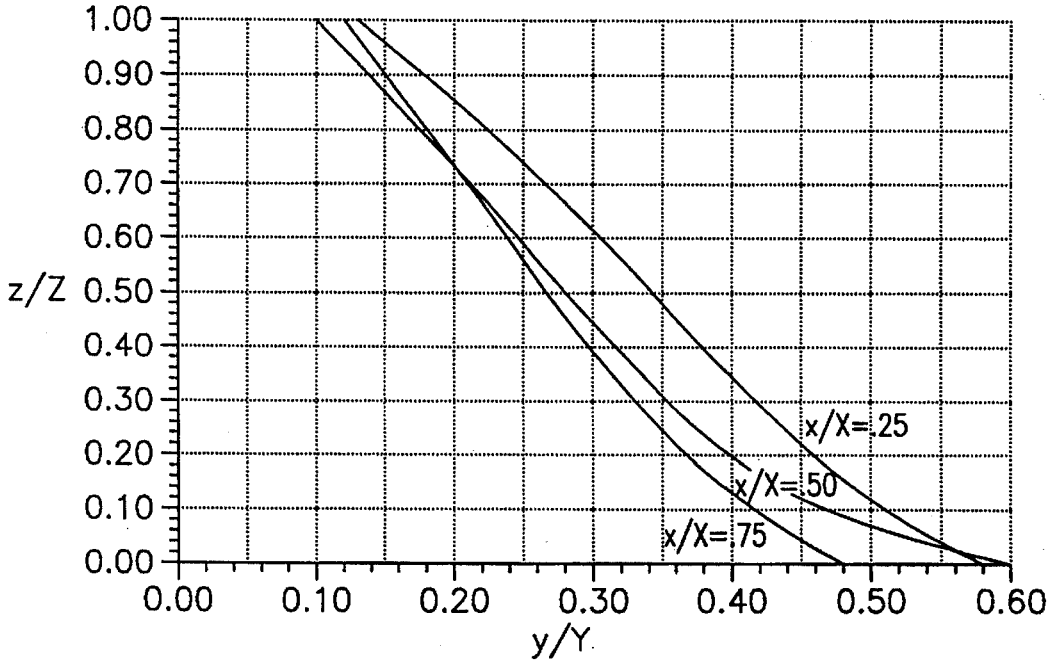
FIG. 9 is a graph illustrating the optimally distributed mass contour over the back side of a seven iron configured according to the invention.
Figure 10:
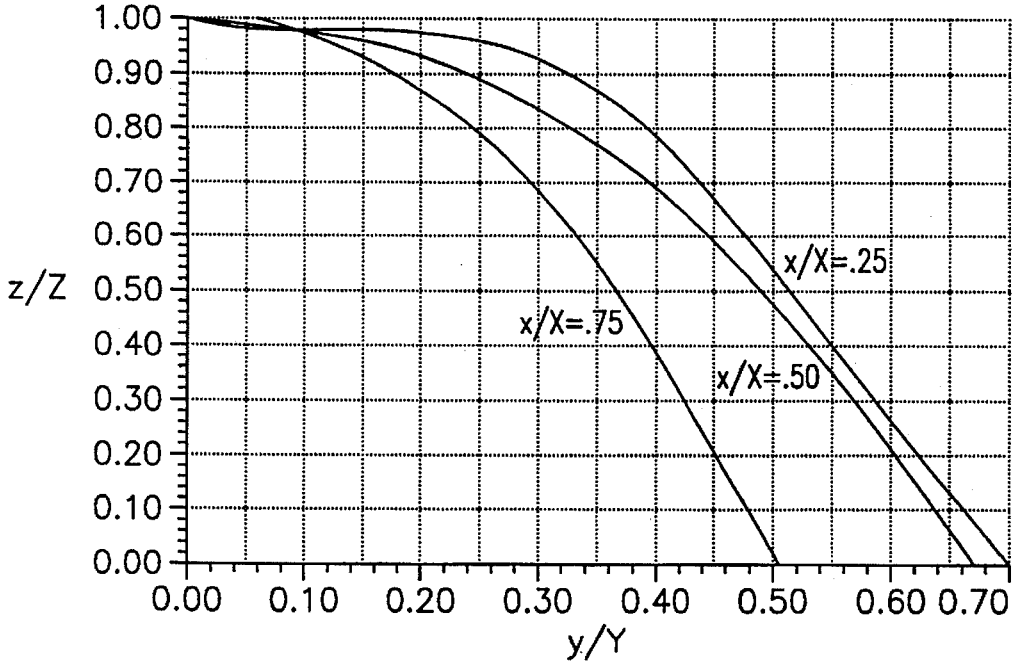
FIG. 10 is a graph illustrating the optimally distributed mass contour over the back side of a wedge configured according to the invention.

Referring now to FIGS. 7 through 10, description can be provided relative to the particular formation of the mass contour 38 of the iron club heads of the invention including those heads comprising a set of clubs configured according to the invention. A generalized profile of a mass contour 38 for any club head of a set is roughly shown by the graph of FIG. 7 while FIGS. 8, 9 and 10 provide graphs which characterize the optimally distributed mass shape respectively of a four iron, seven iron and wedge. While compound contour surfaces such as the optimally distributed mass shape of any one of the mass contours 38 can be conveniently defined with vector equations, it is convenient for visualization to utilize surfaces defined in Cartesian coordinates. As a particular example, reference is made to FIG. 8 which is a graph illustrating the mass contour 38 of a #4 iron configured according to the invention with the graph essentially illustrating the profile of the optimally distributed mass contour 38 as the contour exists along the backside 18 and between the sole 20 and the relief 36 bounded by the top rib 30 and the toe rib 32. In this situation, as can be seen in FIGS. 2 and 3, the optimally distributed mass shape of the mass contour 38 can be defined by any iron head geometry of X, Y and Z where X is the distance from the point of intersection of a line representing the longitudinal axis of a conventional bore in the hosel 14 (referring to FIGS. 1 through 3) and wherein the iron head is oriented at the appropriate "loft" angle, and the ground plane taken to the toe 24 of the club head; Y is the face height measured along the plane of the face 16 at any point along X; and Z is the distance to the back of the sole 20 measured normally to the back side 18 at the same point as Y is taken. The dimension z is the height of the optimally distributed mass surface represented by the mass contour 38 at y and which can be determined as a function of y for the ratios of x/X as shown. For example, the value of X for the #4 iron is 3.85 inches. Using data for x/X=0.50, the y,z profile is established at x=1.93 inches. For this value of x, Y=1.90 on the #4 iron. By inspection of the end points on the graph of FIG. 8 for the curve x/X=0.50, the maximum value of z/Z is 1.0 at y/Y being equal to zero. Similarly the minimum value of z/Z is 0.0 at y/Y=0.47. For the #4 iron, Z is taken to be 0.50 inches. Accordingly, when y=0, z=0.50 inches and when y=0.88 inches, z=0 inch. In between these values of y and z, additional values for z can be determined by selecting additional values of y. In Table II, additional values of z are provided for three additional values of y.

TABLE II

| y | y/Y | z/Z | z |
|---|---|---|---|
| .22 | .12 | .88 | .44 |
| .44 | .23 | .51 | .26 |
| .66 | .35 | .19 | .09 |

When plotting the values thus determined for z relative to those values for y, it can be seen in the graph of FIG. 7 that a determination has been made of the profile of an optimally distributed mass surface corresponding to the mass contour 38 lying along a plane located at x being equal to 1.93 inches. The graph of FIG. 7 presents this profile. While the profile of FIG. 7 is "angular" due to the use of only five values of y, it will be readily understood that the profile of the curvature of the mass contour 38 will become more like a curve as more values of y are evaluated or if equations such as those presented in Table III are used. Repeating the foregoing process for other values of x/X as are presented, along with interpolated values of x/X, provides values of z for the range of y corresponding to any value of x.

Those values of x/X equivalent to 0.25, 0.50 and 0.75 respectively, are given in Table III which relates to FIG. 8 and which is as follows:

TABLE III $$\frac{x/X = .25}{z/Z = 113} \quad (y/Y)^4 - 50.0\,(y/Y)^3 - 6.83\,(y/Y)^2 + .873\,(y/Y) + 1.00 \quad (0 \leqq (y/Y) \leqq .36)$$

$$\frac{x/X = .50}{z/Z = -30.6} \quad (y/Y)^4 + 47.1\,(y/Y)^3 - 21.6\,(y/Y)^2 + .785\,(y/Y) + 1.00 \quad (0 \leqq (y/Y) \leqq .47)$$

$$\frac{x/X = .75}{z/Z = 106} \quad (y/Y)^4 - 12.9\,(y/Y)^3 - 21.6\,(y/Y)^2 + 1.66\,(y/Y) + 1.00 \quad (0 \leqq (y/Y) \leqq .35)$$

Similarly, the contours of the mass contour 38 of a #7 iron configured according to the invention is provided by FIG. 9 with x/X values for 0.25, 0.50 and 0.75 being provided in Table IV as follows:

TABLE IV $$\frac{x/X = .25}{z/Z = 2.48} \quad (y/Y)^4 + 9.22\,(y/Y)^3 - 11.2\,(y/Y)^2 + 1.20\,(y/Y) + 1.00 \quad (0 \leqq (y/Y) \leqq .58)$$

$$\frac{x/X = .50}{z/Z = -34.4} \quad (y/Y)^4 + 55.7\,(y/Y)^3 - 27.6\,(y/Y)^2 + 2.29\,(y/Y) + 1.00 \quad (0 \leqq (y/Y) \leqq .60)$$

$$\frac{x/X = .75}{z/Z = -35.4} \quad (y/Y)^4 + 61.0\,(y/Y)^3 - 31.4\,(y/Y)^2 + 2.83\,(y/Y) + 1.00 \quad (0 \leqq (y/Y) \leqq .46)$$

Still further, the optimally distributed mass provided by the mass contour 38 of a pitching wedge configured according to the invention is shown in the graph of FIG. 10 with respective x/X values of 0.25, 0.50 and 0.75 being provided in Table V.

TABLE V

| | |
|---|---|
| $\frac{x/X = .25}{z/Z = 14.7}$ | $(y/Y)^4 - 20.2(y/Y)^3 + 5.62(y/Y)^2 - .500(y/Y) + 1.00$ $(0 \leqq (y/Y) \leqq .70)$ |
| $\frac{x/X = .50}{z/Z = 2.71}$ | $(y/Y)^4 - 4.61(y/Y)^3 - .276(y/Y)^2 - .068(y/Y) + 1.00$ $(0 \leqq (y/Y) \leqq .67)$ |
| $\frac{x/X = .75}{z/Z = 54.5}$ | $(y/Y)^4 - 53.6(y/Y)^3 + 10.9(y/Y)^2 - .796(y/Y) + 1.00$ $(0 \leqq (y/Y) \leqq .51)$ |

Reference is again made to FIGS. 2 and 3 wherein the values of X, Y and Z as well as x, y and z are seen to be taken from an iron club head configured according to the invention.

Figure 12:
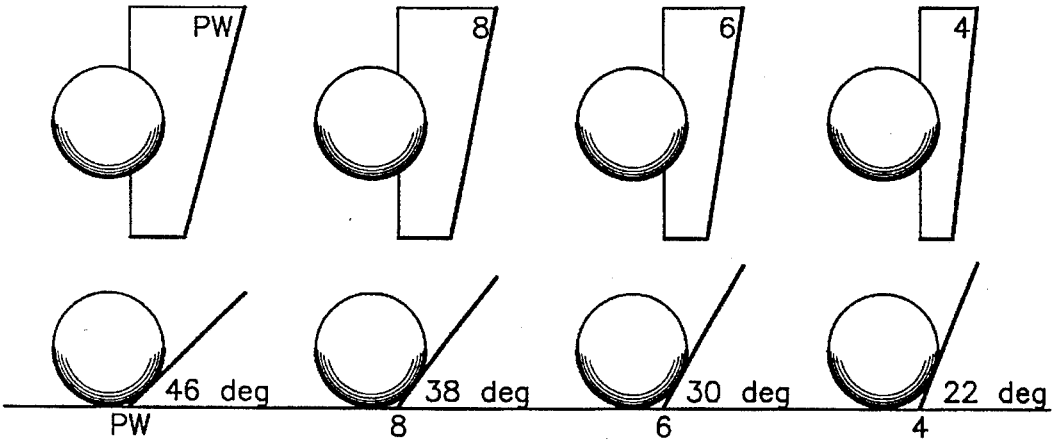
FIG. 12 is a series of interrelated schematics illustrating typical projected areas viewed by a player according to the dimensions of the iron heads of typical prior art irons.

Referring now to FIG. 12, the "sight picture" of representative club heads of the prior art can be appreciated as viewed from the address position. In these prior art situations, the sight pictures are not of a uniform size and thus do not inspire confidence in the mind of a player.

Figure 13:
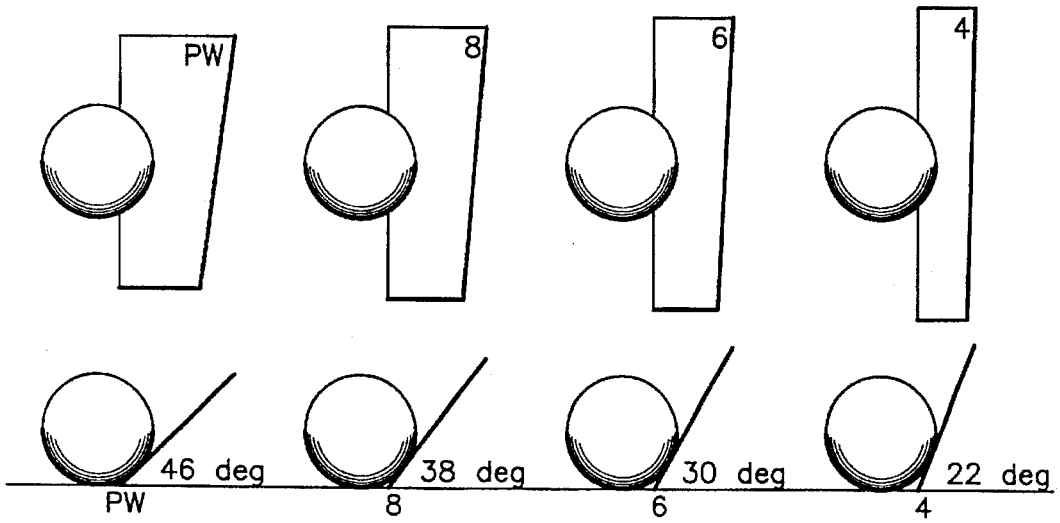
FIG. 13 is a series of interrealted schematics illustrating typical projected areas viewed by a player according to the dimensions of the iron heads of the present invention.

In contradistinction, reference to FIG. 13 shows the "sight picture" of representative iron heads configured according to the invention when viewed from the address position, the sight pictures being of a more uniform projected size due to incremental sizing along a set of clubs from a pitching wedge having the shortest face length to a #4 iron having the longest face length. This incremental sizing, when coupled with proportional increases in face height combined with the face angle (loft) of the several club heads provides a more consistent face projected area which promotes player confidence. FIG. 13 illustrates these features for iron head sizes #4, #6, #8 and pitching wedge. It is seen that the #4 iron appears to present a projected area nearly equal to that of the pitching wedge. In fact, the projected area of the #4 iron is 65% of the pitching wedge projected area. However, the present club heads provide a view to the player or a sight picture for each iron head which is more uniformly sized. In traditional iron heads as well as in contemporary perimeter weighted iron heads including mid and oversize head designs, any given iron head is smaller than the corresponding iron head according to the invention and the apparent size difference between a short iron and a long iron is more pronounced. In typical traditional and perimeter weighted irons, the #4 iron projected area is only 40% that of the pitching wedge. Accordingly, the more uniform iron head size sight picture presented by the present iron club heads along with the greater physical size when compared to typical irons of the presently configured irons acts to promote tremendous player confidence.

Although the invention has been described with reference to particular embodiments thereof, it is to be appreciated that modifications, alternatives, variations and the like may be made without departing from the spirit and scope of the invention as defined in the appended claims.

What is claimed is:

1. A golf iron head comprising a heel end, toe end, sole, top edge, a planar striking face, a back side having a surface and a hosel for connection with a shaft, the head having a center of mass, a contoured mass disposed on the back side of the head and extending above the surface of said back side, a major portion of the contoured mass being disposed in an area located about the center of mass of the head and medially of the length of the sole with the mass having a shape which tapers from a height which is greater at the sole toward the top edge centrally of the back side of the head to a height equal that of the back side, respective portions of the contoured mass disposed along the sole nearmost the heel end and nearmost the toe end of the head tapering toward the hosel and tapering toward the toe end of the head respectively to a height equal that of the back side, the respective portions of the mass located toward the heel end and toe end being lesser portions of the mass, said lesser portions of the mass disposed respectively nearmost the heel end and toe end of the head respectively also tapering toward the top edge of the head from a greater height at the sole to a height equal that of the back side, the major portion of the mass further tapering from the sole toward the top edge centrally of the sole extending more closely to the top edge than do either of those lesser portions of the mass located toward the heel end and the toe end of the head, thereby to provide an unusually large golf club head with an unusually large effective hitting area on the planar striking face of the head while retaining a weight similar to the weight of a conventional tour blade iron head of the same number having a generally continuous back side.

2. The golf iron head of claim 1 wherein the shape of at least a major portion of the contoured mass extending above the surface of the back side of the head between ends of the head is arcuate in contour.

3. The golf iron head of claim 1 wherein the contoured mass disposed between ends of the head taper from the sole fully to the top edge of the head.

4. The golf iron head of claim 3 wherein those tapering portions of said mass which extend nearmost the top edge of the head from centrally of the sole on the back side of the head comprise only lesser portions of the mass.

5. The golf iron head of claim 1 wherein the contoured mass forms compound contoured surfaces which extend from the back side of the head medially of the sole to a height above the back side which is greater than respective heights of the lesser portions of the mass located at ends of the sole toward the heel end and toward the toe end of the head.

6. The golf iron head of claim 1 wherein surfaces of the contoured mass disposed near the sole extend from the back side of the head to respective heights above the back side which are greater than heights of surfaces of those portions of the mass which extend toward the top edge of the head.

7. The golf iron head of claim 5 wherein respective surfaces of the mass disposed medially of the sole and surfaces of the mass at respective ends of the sole extend from the back side of the head to respective heights above the back side which are greater than heights of surfaces of those portions of the mass which extend toward the top edge of the head.

8. The golf iron head of claim 1 wherein the back side of the head is formed without a cavity therein.

9. The golf iron head of claim 1 and further comprising stiffening ribs formed one each along only the top edge of the head and along the toe end of the head.

10. The golf iron head of claim 9 wherein the stiffening ribs disposed along the top edge and along the toe end respectively terminate and join at the toe end of the head.

11. A golf iron head comprising a heel end, toe end, sole, top edge, a planar striking face, a back side having a surface and a hosel for connection with a shaft, the head having a center of mass, a contoured mass disposed over major portions of the back side of the head and extending above the surface of said back side, major portions of the contoured mass being disposed in an area located about the center of mass of the head and medially of the length of the sole with the mass having a shape which tapers from a height which is greater at the sole toward the top edge centrally of the back side of the head to a height equal that of the back side, respective portions of the mass disposed along the sole nearmost the heel end and nearmost the toe end of the head tapering toward the hosel and tapering toward the toe end of the head respectively to a height equal that of the back side, the respective portions of the mass thus located toward the heel end and the toe end being lesser portions of the mass, said lesser portions of the mass disposed respectively nearmost the heel end and the toe end of the head respectively also tapering toward the top edge of the head from a greater height at the sole to a height equal that of the back side, the major portions of the mass further tapering from the sole toward the top edge centrally of the sole extending more closely to the top edge than to either of those lesser portions of the mass located toward the heel end and the toe end of the head, the contoured mass forming compound contoured surfaces which extend from the back side of the head medially of the sole to a height above the back side which is greater than the respective heights of the lesser portions of the mass located at ends of the sole toward the heel end and toward the toe end of the head, thereby to provide an unusually large golf club head with an unusually large effective hitting area on the planar striking face of the head while retaining a weight similar to the weight of a conventional tour blade iron head of the same number having a generally continuous back side.

12. The golf iron head of claim 11 and further comprising stiffening ribs formed one each along the top edge of the head and along the toe end of the head.

13. The golf iron head of claim 12 wherein the stiffening ribs disposed along the top edge and along the toe end respectively terminate and join at the toe end of the head.

14. The golf iron head of claim 11 wherein the shape of at least major portions of the contoured mass extending above the surface of the back side of the head between the ends of the head is arcuate in contour.

15. The golf iron head of claim 11 wherein the contoured mass disposed between ends of the head taper from the sole fully to the top edge of the head.

16. The golf iron head of claim 15 wherein those tapering portions of said mass which extend nearmost the top edge of the head from centrally of the sole on the back side of the head comprise only lesser portions of the mass.

17. The golf iron head of claim 11 wherein respective surfaces of the mass disposed medially of the sole and surfaces of the mass at respective ends of the sole extend from the back side of the head to respective heights above the back side which are greater than heights of the surfaces of those portions of the mass which extend toward the top edge of the head.

18. A golf iron head comprising a heel end, toe end, sole, top edge, a planar striking face, a back side having a surface and a hosel for connection with a shaft, the head having a center of mass, a contoured mass disposed over major portions of the back side of the head and extending above the surface of said back side, major portions of the mass being disposed in an area located about the center of mass of the head and medially of the length of the sole with the mass having a shape which tapers from a height which is greater at the sole toward the top edge centrally of the back side of the head to a height equal that of the back side, respective portions of the contoured mass disposed along the sole nearmost the heel end and nearmost the toe end of the head tapering toward the hosel and tapering toward the toe end of the head respectively to a height equal that of the back side, the respective portions of the mass located toward the heel end and toe end being lesser portions of the mass, said lesser portions of the mass disposed respectively nearmost the heel end and toe end of the head respectively also tapering toward the top edge of the head from a greater height at the sole to a height equal that of the back side, the major portions of the mass tapering from the sole toward the top edge centrally of the sole extending more closely to the top edge than to either of those lesser portions of the mass located toward the heel end and the toe end of the head, surfaces of the mass disposed near the sole extending from the back side of the head to respective heights above the back side which are greater than heights of surfaces of those portions of the mass which extend toward the top edge of the head, thereby to provide an unusually large golf club head with an unusually large effective hitting area on the planar striking face of the head while retaining a weight similar to the weight of a conventional tour blade iron head of the same number having a generally continuous back side.

19. The golf club head of claim 18 and further comprising stiffening ribs formed one each along the top edge of the head and along the toe end of the head.

20. The golf iron head of claim 18 wherein the stiffening ribs disposed along the top edge and along the toe end respectively terminate and join at the toe end of the head.

21. The golf iron head of claim 18 wherein the shape of at least major portions of the contoured mass extending above the surface of the back side of the head between the ends of the head is arcuate in contour.

22. The golf iron head of claim 18 wherein the contoured mass disposed between ends of the head taper from the sole fully to the top edge of the head.

23. The golf iron head of claim 22 wherein those tapering portions of said mass which extend nearmost the top edge of the head from centrally of the sole on the back side of the head comprise only lesser portions of the mass.

* * * * *